US007736190B2

(12) United States Patent
Yuan et al.

(10) Patent No.: US 7,736,190 B2
(45) Date of Patent: Jun. 15, 2010

(54) ELECTRICAL CONNECTOR WITH IMPROVED CONTACTS

(75) Inventors: Xin Yuan, Kunshan (CN); Su-Feng Liu, Kunshan (CN); Chin-Te Lai, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/436,800

(22) Filed: May 7, 2009

(65) Prior Publication Data

US 2009/0280663 A1 Nov. 12, 2009

(30) Foreign Application Priority Data

May 7, 2008 (CN) ..... 2008 2 300686

(51) Int. Cl.
*H01R 27/00* (2006.01)

(52) U.S. Cl. ..... 439/660; 439/874; 439/607.48; 439/516

(58) Field of Classification Search ..... 439/660, 439/874, 607.48, 516, 83, 43, 607.47
See application file for complete search history.

(56) References Cited

U.S. PATENT DOCUMENTS 5,273,459 A * 12/1993 Davis ..... 439/607.48
5,725,386 A * 3/1998 Davis et al. ..... 439/79
6,004,160 A * 12/1999 Korsunsky et al. ..... 439/660
6,083,051 A * 7/2000 Chang ..... 439/660
6,390,852 B1 * 5/2002 Wang ..... 439/607.48
6,527,592 B2 * 3/2003 Mochizuki et al. ..... 439/660
6,659,801 B2 * 12/2003 Nishio et al. ..... 439/607.48
7,217,158 B2 * 5/2007 Shimizu ..... 439/607.23
7,618,293 B2 * 11/2009 Wu ..... 439/660
2002/0045385 A1 * 4/2002 Wang ..... 439/610
2002/0142676 A1 * 10/2002 Hosaka et al. ..... 439/874
2003/0232539 A1 * 12/2003 Chen et al. ..... 439/610

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector (100) comprises an insulative housing (10), a shell encapsulating the insulative housing and a plurality of contacts (20) received in the housing abreast. The insulative housing defines a tongue (12), a plurality of passageways (121) and receiving grooves (131), the passageways extending to the tongue, the tongue has a stopping portion (126) in the front of each passageway. A cavity is defined below each stopping portion and communicated with the passageway. Each contact has a contacting portion (21) and a tail portion (23) wider than the contacting portion, the contacting portions are received in a corresponding passageways with the tail portions received in a corresponding receiving grooves. Each contacting portion defines a tab (210) protruding forwardly from a bottom surface thereof, the tab is received in the cavity and protected by the stopping portion (126); each tail portion is stamped downwards to form a notch (231) receiving wires and soldering with the wires.

20 Claims, 5 Drawing Sheets

ELECTRICAL CONNECTOR WITH IMPROVED CONTACTS

BACKGROUND OF THE INVENTION

1. Field of the Invention

The present invention generally relates to an electrical connector, and more particularly to an electrical connector with improved contacts.

2. Description of Related Art

Nowadays, miniaturization of electronic devices, such as notebooks, PDA, etc has become a trend such that the dimension and size of electronic connectors used therein have to be modified and reduced so as to meet the requirements.

CN Patent No. 1049072C issued to Tian on Feb. 2, 2000 discloses a mini USB connector. The mini USB connector comprises an insulative housing, a group of contacts received in the housing and a metallic shielding assembled to the housing. Each contact defines a tail portion with a pair of wings extending laterally, the wings are bent toward each other to receive one of wires therein, to prevent solder from flowing. However, it's difficult to bend the wings when the contact becomes thicker.

Said contacts are received in passages of the housing, but tips of the contacts will sprout upwards as mating time increases. Typically, the tip of the contact is bent down and pressed into the housing to prevent the tip from sprouting upwards. U.S. Pat. No. 5,725,386 issued to Davis on Mar. 10, 1998 discloses an electrical connector with this typical design. The electrical connector comprises an insulative housing, a group of contacts received in the housing and a metallic shielding assembled to the housing, contacting portions of the contacts are bent downwards to merge into a front part of the housing. However, when the contacts are insert-molded within the housing, it's difficult to make tips of the contacts and main bodies of the contacts locate on a same plane.

Hence, it is desirable to have an improved structure to overcome the above-mentioned disadvantages of the prior art.

BRIEF SUMMARY OF THE INVENTION

Accordingly, the object of the present invention is to provide an electrical connector with improved contacts for soldering conveniently and preventing jumping outwards thereof from an insulative housing.

In order to achieve the above-mentioned object, an electrical connector in accordance with the present invention comprises an insulative housing, a shell encapsulating the insulative housing and a plurality of contacts received in the housing abreast. The insulative housing defines a tongue, a plurality of passageways and receiving grooves, the passageways extending to the tongue, the tongue has a stopping portion in the front of each passageway. A cavity is defined below each stopping portion and communicated with the passageway. Each contact has a contacting portion and a tail portion wider than the contacting portion, the contacting portions are received in a corresponding passageways with the tail portions received in a corresponding receiving grooves. Each contacting portion defines a tab protruding forwardly from a bottom surface thereof, the tab is received in the cavity and protected by the stopping portion; each tail portion is stamped downwards to form a notch receiving wires and soldering with the wires.

Other objects, advantages and novel features of the invention will become more apparent from the following detailed description of the present embodiment when taken in conjunction with the accompanying drawings.

DETAILED DESCRIPTION OF THE INVENTION

Figure 1:
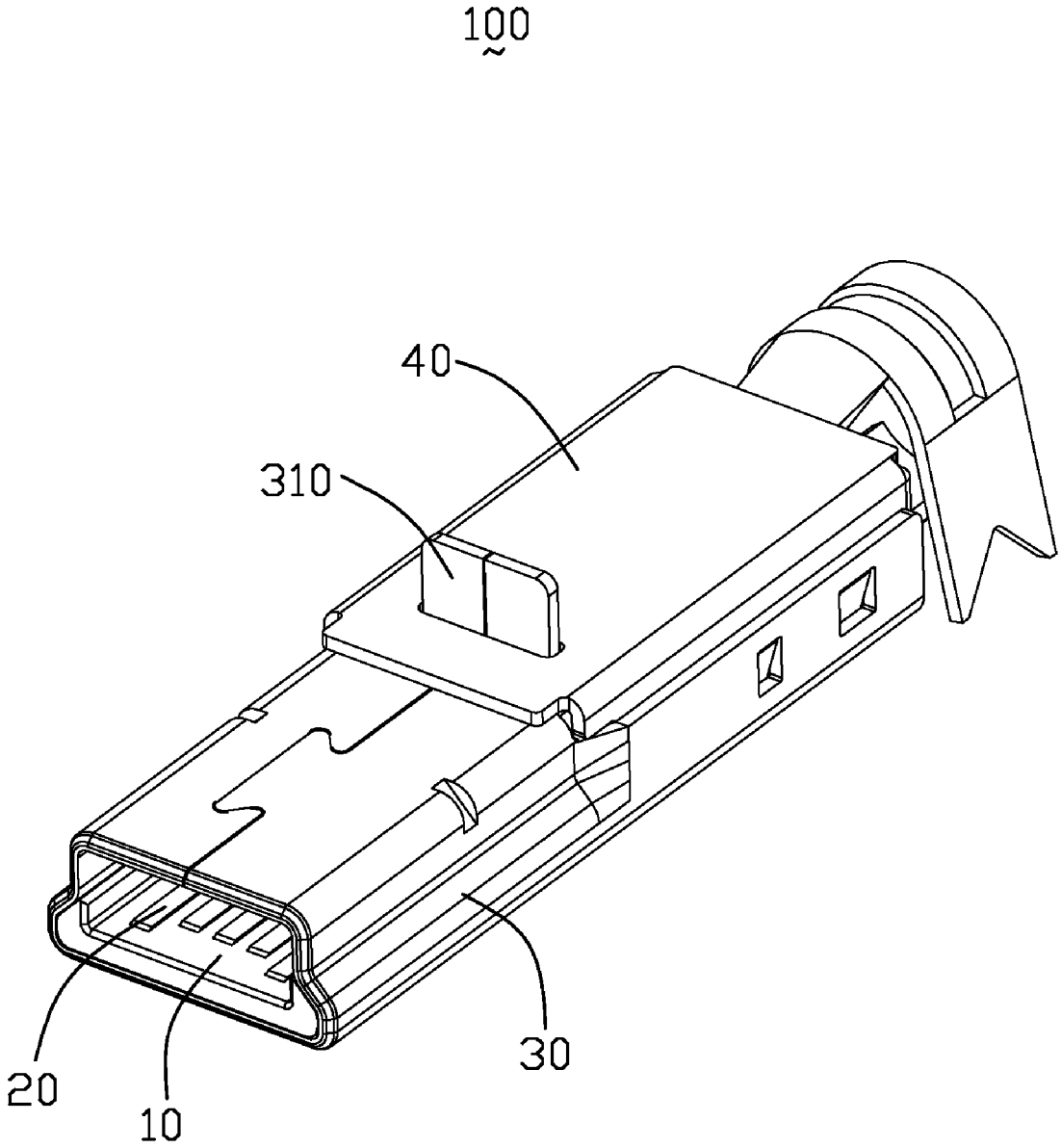
FIG. 1 is an assembled view of an electrical connector in accordance with the present invention.

Reference will now be made to the drawing figures to describe the present invention in detail.

Figure 2:
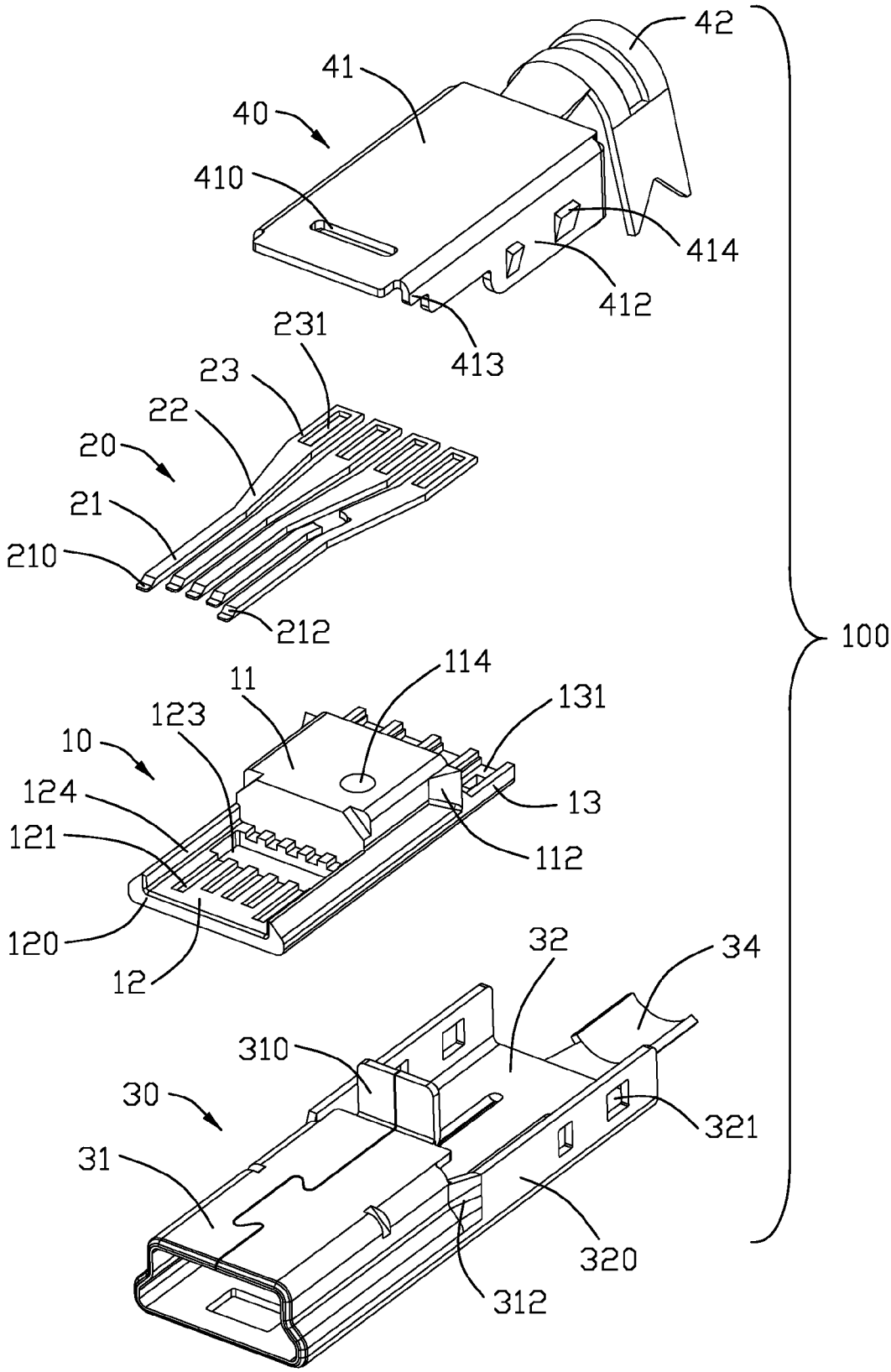
FIG. 2 is an exploded view of FIG. 1.

Referring to FIGS. 1-2, an electrical connector 100 in accordance with the present invention comprises an insulative housing 10, a contact set 20 molded in the insulative housing 10, a bottom shell 30 attached to the housing 10 and a top shell 40 assembled to a back portion of the bottom shell 30 along an up-to-down direction.

Figure 3:
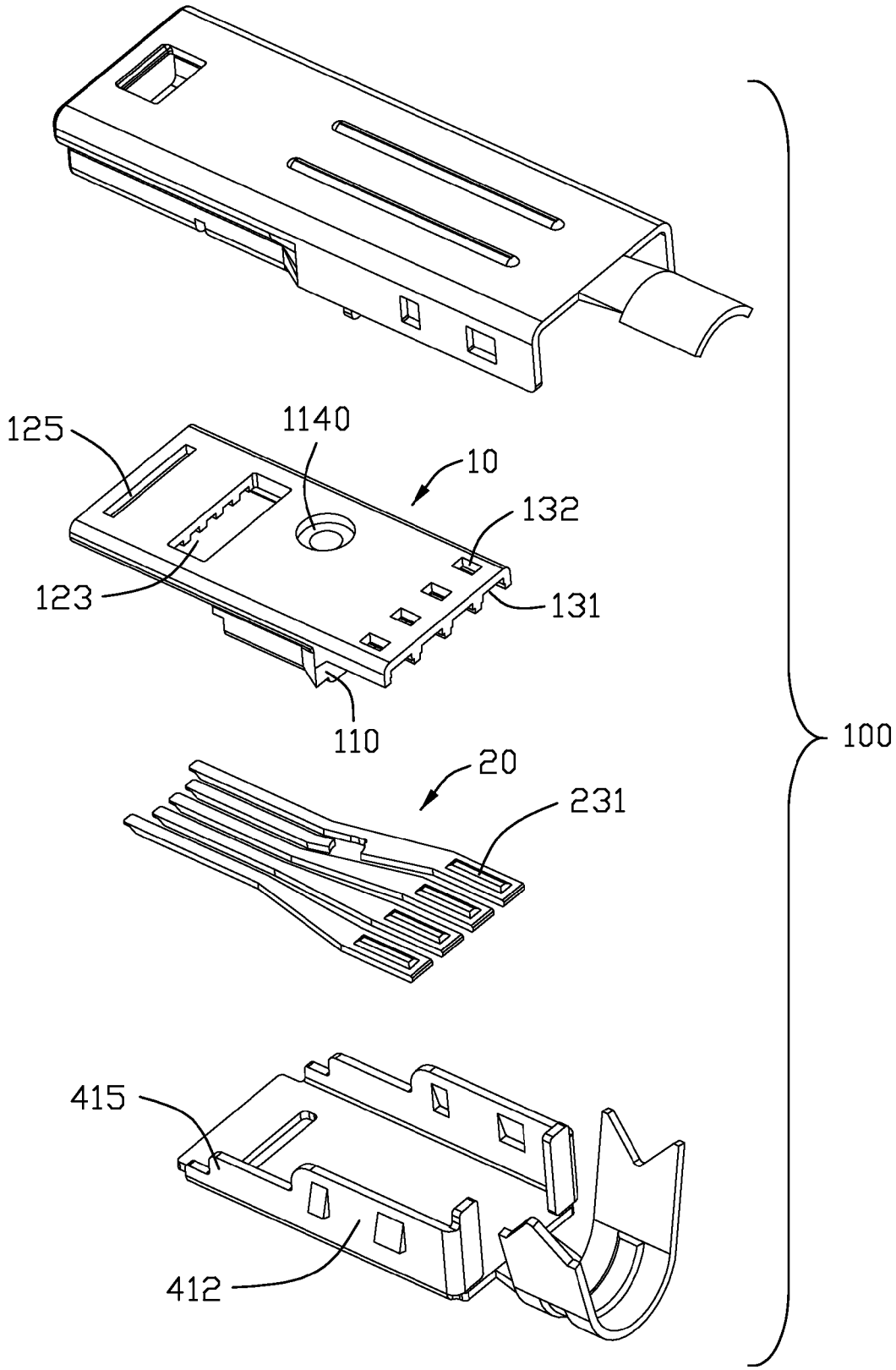
FIG. 3 is a view similar to FIG. 2, but viewed from a different angle.
Figure 4:
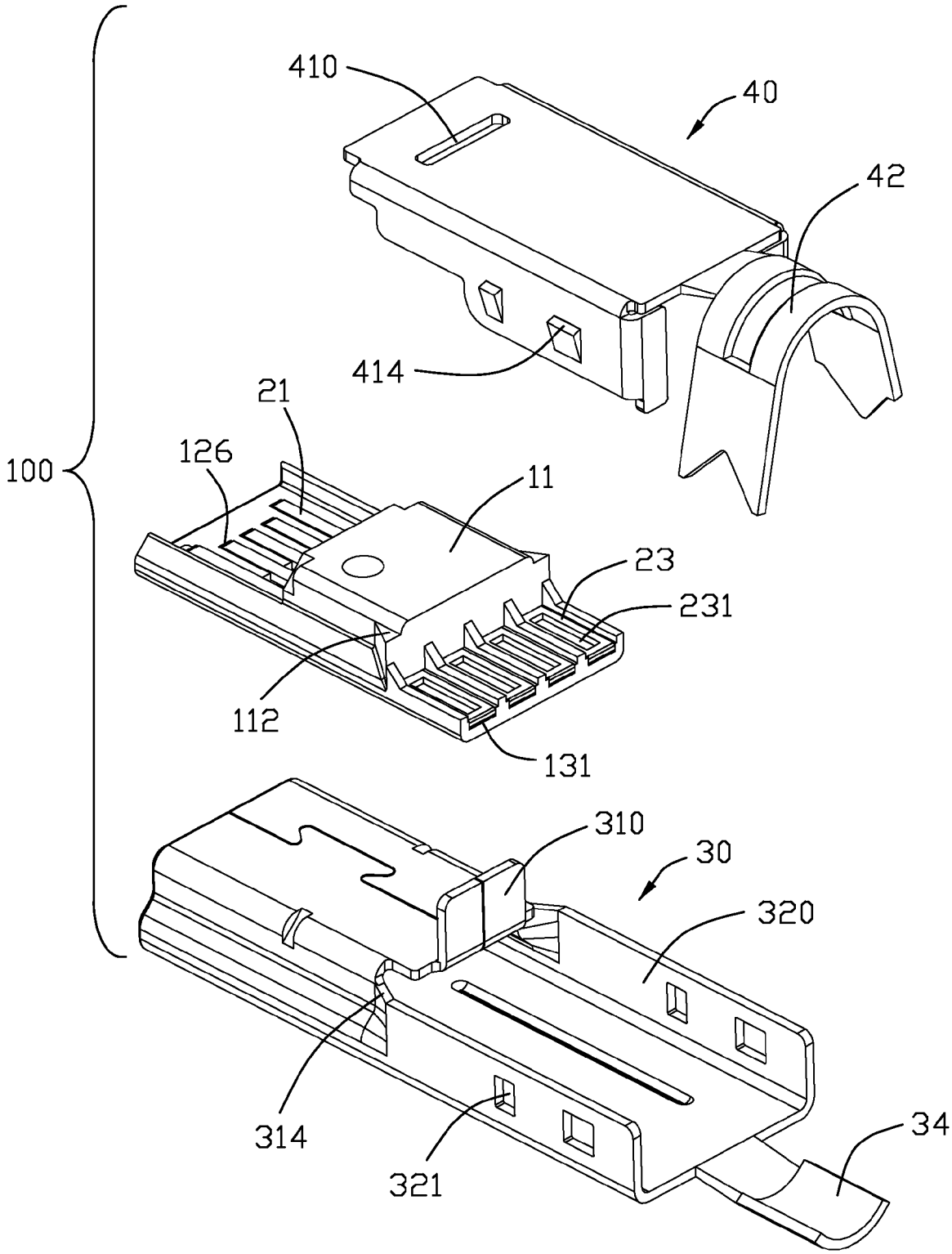
FIG. 4 is an exploded, perspective view of the electrical connector, with contacts thereof inserted into a housing.
Figure 5:
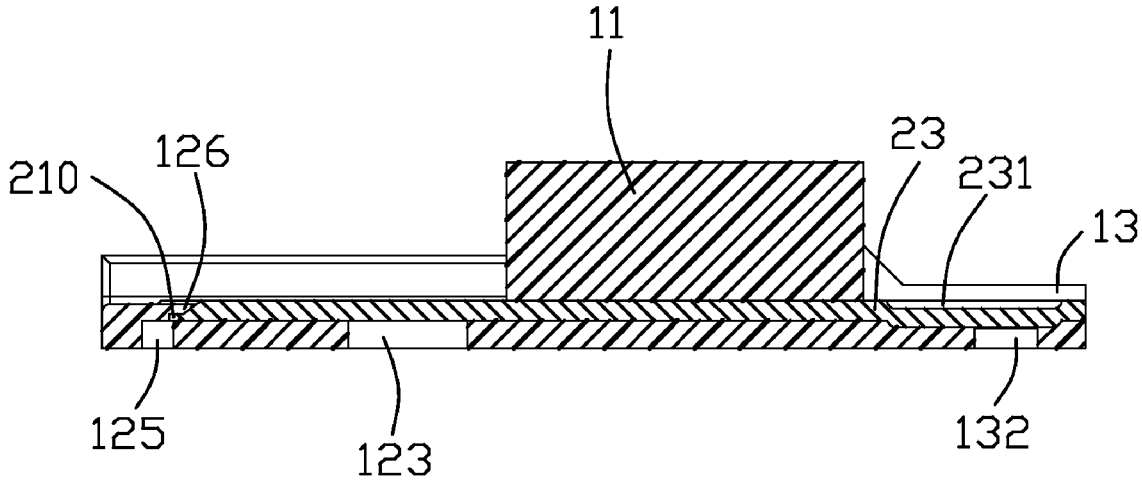
FIG. 5 is a cross-section view of FIG. 1.

Referring to FIGS. 2-4, the insulative housing 10 of the electrical connector 100 comprises a base portion 11, a U-shape tongue 12 extending forwardly from the base portion 11 along a mating direction and a supporting portion 13 extending rearwards from the base portion 11. The base portion 11 defines a pair of block portion 112 extending outwards from back sections of lateral sides thereof, the block portions 112 are connected with the supporting portion 113. A circular hole 114 is defined in the base portion 11, and upper segment of hole 114 is smaller than lower segment in dimension to form a step 1140. A plurality of passageways 121 are defined in the tongue 12. A plurality of stopping portions 126 are defined in a front end of the tongue 12, each stopping portion 126 is located adjacent to corresponding passageway 121. A cavity (not numbered) is defined below the stopping portion 126 and communicated with the passageway 121. The passageways 121 at lateral sides are longer than those in middle portions of the tongue 12, that is to say, front ends of the passageways 121 at lateral sides are closer to a mating surface 120 of the tongue 12. The passageways 121 extend rearwards, then penetrate the base portion 11 and communicate with the supporting portion 13. The tongue 12 defines an opening 123 along a transverse direction and a slit 125, the opening 123 is located adjacent to the base portion 11 and divides the passageways 121 into two segments with different lengths. The slit 125 is extending upwards from bottom surface of the tongue 12 but not through the tongue 12. The supporting portion 13 is of U-shaped, and defines a plurality of receiving grooves 131, and each receiving groove 131 defines an aperture 132 in an inner wall thereof. Upper part of the receiving groove 131 is wider than the lower part.

The contact set 20 is insert-molded within the insulative housing 10, and comprises five contacts arranged side-by-side on a same plane. Each contact comprises a contacting portion 21 for electrically connected with a complementary connector, a retention portion 22 extending rearwards from the contacting portion 21, and a flat tail portion 23 extending rearwardly from the retention portion 22. The contacting portions 21, the retention portions 22 and the tail portions 23 of the contact set 20 are on a same plane. The contacting portion 21 extends forwardly to form a tab 210, the contacting portion 21 is received in the passageway 121. The tab 210 is received in the cavity and kept in thereof by the stopping portion 126. The contacts located at opposite sides of the contact set 20 have longer contacting portions 21. During manufacturing, a holding mechanism (not shown) is located in the opening 123 to retain the contact set 20, a supporting mechanism (not shown) is located in the slit 125 and the aperture 132 to support the contact set 20. The retention portion 22 is received in the base portion 11 and becomes wider from the connecting area with the contacting portion 21 to the connecting area with the tail portion 23. The two contacts located on left side have the conjunct retention portion 22 and tail portion 23, the retention portion 22 on left is connected with the contacting portion 21 of the first contact on left, part of the retention portion 22 is removed away to form a cutout (not numbered) and make the second contact on left not connect with the tail portion thereof, the cutout is aligning with the hole 114 of the insulative housing 10. Operator can cut off the second contact from the hole 114 to form the cutout. The tail portions 22 of the contact set 20 have the same configuration as each other, and are received in the narrower segment of the receiving groove 131. A rectangular notch 231 is stamped on the tail portion 23 of each contact, the notch 231 extends downwards beyond the bottom surface of the contact, and locates above the aperture 132.

The bottom shell 30 comprises a convex main body 31, an extension portion 32 and a sustaining portion 34 extending from the extension portion 32. The main body 31 is bending upwards to form a locking tab 310, both sides of the main body 31 are connected with first lateral walls 320 of the extension portion 32 by irregular conjoint portions 312. A gap 314 is arranged between upper side of the conjoint portion 312 and upper wall of the main body 31. The extension portion 32 is of U-shaped, the first lateral wall 320 defines a pair of receiving holes 321 with different width and in the same height.

The top shell 40 comprises a U-shaped casing portion 41 and a wrapping portion 42 located behind the casing portion 41, the casing portion 41 defines a locking hole 410 along a transversal direction and a pair of second lateral walls 412, the locking hole 410 is in front end of the casing portion 41. The second lateral wall 412 defines a first flange 413 and a second flange 415 behind the first flange 413, a plurality of protrusions 414 are arranged on the second lateral walls 412 and corresponding to the receiving holes 321.

Referring to FIG. 1 and conjunction with FIG. 4, in assembling, the contact set 20 is insert-molded within the insulative housing 10, a plurality of wires (not shown) are placed in the notch 231 of the tail portions 23 and soldered therein. Then the insulative housing 10 is assembled to the bottom shell 30 along the back-to-front direction, and the block portions 112 are adjacent to the conjoint portions 312. The tongue 12 and the base portion 11 are both located in the main body 31 of the bottom shell 30, the supporting portion 13 is located in the extension portion 32 with the wires on the sustaining portion 34. The top shell 40 is assembled to the extension portion 32 of the bottom shell 30 along the up-to-down direction, the locking tab 310 is protruding into the locking hole 410, the protrusions 414 are positioning in the corresponding receiving holes 321. The first flange 413 is received in the gap 314, and the second flange 415 is adjacent to a back end surface 110 of the base portion 11 to prevent the insulative housing from falling back, the wrapping portion 42 encloses the wires together with the sustaining portion 34.

Then, a cover (not shown) is over-molded on the above-mentioned component. Therefore, the electrical connector 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a tongue, a plurality of passageways and receiving grooves, the passageways extending to the tongue, the tongue having a stopping portion in the front of each passageway, a cavity defined below the stopping portion and communicated with the passageway;

a shell encapsulating the insulative housing; and a plurality of contacts received in the housing side by side, each contact having a contacting portion and a tail portion wider than the contacting portion, the contacting portion received in a corresponding passageway with the tail portion received in a corresponding receiving groove, the contacting portion defining a tab protruding forwardly from a bottom surface thereof, the tab received in the cavity and protected by the stopping portion; the tail portion stamped downwards to form a notch receiving wires and soldering with the wires.

2. The electrical connector as claimed in claim 1, wherein the notch protrudes downwards with a lower wall thereof beyond a bottom surface of the contact.

3. The electrical connector as claimed in claim 2, wherein each receiving groove defines an aperture in an inner wall thereof, the protruding part of the notch is located above the aperture.

4. The electrical connector as claimed in claim 1, wherein each receiving groove is defined with an upper segment thereof wider than a lower segment.

5. The electrical connector as claimed in claim 4, wherein the tail portions are received in the lower segment of the receiving groove.

6. The electrical connector as claimed in claim 1, wherein the tab is thinner than the mating segment of the contacting portion.

7. The electrical connector as claimed in claim 1, wherein each contact further comprises a retention portion between the contacting portion and the tail portion, the retention portion becomes wider from the connecting area with the contacting portion to the connecting area with the tail portion.

8. The electrical connector as claimed in claim 7, wherein one of the contacts is divided into two parts by a cutout therein.

9. The electrical connector as claimed in claim 8, wherein the cutout is defined in the retention portion of the one contact.

10. The electrical connector as claimed in claim 9, wherein the insulative housing defines a base portion extending rearwards from the tongue, a hole is defined in the base portion.

11. The electrical connector as claimed in claim 10, wherein the cutout is aligned with the hole.

12. The electrical connector as claimed in claim 1, wherein the shell comprises a top shell and a bottom shell, wherein both sides of the top shell defines a plurality of flanges and protrusions.

13. The electrical connector of claim 12, wherein the bottom shell defines a gap and a plurality of receiving holes cooperated with corresponding flanges and protrusions.

14. The electrical connector of claim 12, wherein a locking hole is defined in the top shell along a transverse direction, the bottom shell defines a locking tab received in the locking hole.

15. An electrical connector comprising:

a plurality of contacts arranged side by side with one another and including front contacting sections and rear soldering sections under condition that said soldering sections are outwardly spanned laterally in comparison with the contacting sections;

a specific one of said contacts only having the contacting section originally sharing the same soldering section with the neighboring contact;

said contacts assembled with an insulative housing via an insert molding process with means for restraining the contacts from moving relative to the housing; wherein said housing defines a through hole for removing an intermediate linkage between the contacting section of the specific one of said contacts and said same soldering section shared with the neighboring contact.

16. The electrical connector as claimed in claim 15, wherein a rear portion of the contact section of said specific one of the contacts is embedded in the housing, and a rear end of the contact section of said specific one of the contacts is flush with a boundary of said through hole.

17. The electrical connector as claimed in claim 15, wherein a front end of the contact section of said specific one of the contacts is embedded in the housing.

18. The electrical connector as claimed in claim 15, wherein in each of the remaining contacts except said specific one of the contacts, an intermediate outward deflected angled linkage is located between the corresponding contacting section and soldering section so as to preclude possibility of an assembly method of inserting the contacts into the housing.

19. An electrical connector comprising:

an insulative housing; and a plurality of contacts having front contacting sections and rear soldering sections, respectively, wherein the housing has a supporting face defining a plurality of notches each to receive a downward protrusion of the corresponding solder section, and the downward protrusion forming in a recess to receive solder which binds a wire and said solder section under condition that the wire and the supporting face are respectively located by opposite faces of the soldering section.

20. The electrical connector as claimed in claim 19, wherein said housing and said contacts are configured to preclude insertion of the contacts into the housing during assembly but via an insert molding procedure.

* * * * *